US008919884B2

(12) United States Patent
Lee

(10) Patent No.: US 8,919,884 B2
(45) Date of Patent: Dec. 30, 2014

(54) METHOD AND APPARATUS FOR A SINGLE SLING CHAIR

(75) Inventor: Clifton Shao-ming Lee, Hillsborough, CA (US)

(73) Assignee: Numark Industries Company Limited, Hung Hom (CN)

( * ) Notice: Subject to any disclaimer, the term of this patent is extended or adjusted under 35 U.S.C. 154(b) by 328 days.

(21) Appl. No.: 13/065,731

(22) Filed: Mar. 28, 2011

(65) Prior Publication Data

US 2011/0233984 A1 Sep. 29, 2011

(51) Int. Cl.
*A47C 5/06* (2006.01)
*A47C 31/02* (2006.01)
*A47C 7/40* (2006.01)

(52) U.S. Cl.
CPC ..... *A47C 31/023* (2013.01); *A47C 5/06* (2013.01); *A47C 7/40* (2013.01)
USPC ..... 297/440.11; 297/463.2

(58) Field of Classification Search
USPC ..... 297/284.2, 440.11, 452.1, 452.18, 297/463.2
See application file for complete search history.

(56) References Cited

U.S. PATENT DOCUMENTS 3,289,220 A * 12/1966 Grimshaw ..... 297/452.56
3,844,612 A * 10/1974 Borggren et al. ..... 297/451.3
4,410,027 A * 10/1983 Lucous ..... 160/380
4,788,806 A * 12/1988 Sease ..... 52/222
5,015,034 A * 5/1991 Kindig et al. ..... 297/227
5,121,963 A * 6/1992 Kwasnik et al. ..... 297/227
6,494,540 B1 * 12/2002 Tornero ..... 297/440.1
6,511,562 B1 * 1/2003 Coffield ..... 297/440.11
6,585,323 B2 * 7/2003 Gaylord et al. ..... 297/440.11
6,779,849 B1 * 8/2004 Harper et al. ..... 297/452.13
7,159,293 B2 * 1/2007 Coffield et al. ..... 29/449
8,317,270 B2 * 11/2012 Tseng ..... 297/452.2
8,403,421 B2 * 3/2013 Wang ..... 297/440.11

* cited by examiner

*Primary Examiner* — Peter Brown
(74) *Attorney, Agent, or Firm* — Daniel Hopen

(57) ABSTRACT

Some embodiments of the present invention provide a method and apparatus for a novel single sling chair. The single sling chair simplifies the manufacture of sling chairs affording efficient and speedy construction. The single sling chair comprises a chair frame having a back section with an upper rail and a lower cross member and a seat section, a seat panel coupled to the seat section of the chair frame, a fabric back panel having length and first and second terminating loops at opposing ends with a first rod fitting inside the first terminating loop and a second rod fitting inside the second terminating loop, an upper rail having an interior side configured to fit the first rod and the first terminating loop into the interior side of the upper rail, and a lower rail having an interior side configured to fit the second rod and the second terminating loop into the interior side of the lower rail wherein the lower rail is attached to the lower cross member of the chair frame to form a back rest for the back section.

9 Claims, 4 Drawing Sheets

METHOD AND APPARATUS FOR A SINGLE SLING CHAIR

RELATED APPLICATION

This application claims priority from Chinese patent application entitled "A Type of Chair with Back Support" filed on Mar. 29, 2010 having a Chinese Application No. 201020143819.0, and issued on Nov. 24, 2010 having a Chinese Patent No. CN 201641120 U. The Chinese application is incorporated herein by reference.

BACKGROUND

1. Technical Field

This disclosure generally relates to sling chairs, and more particularly to a single-sling chair wherein insertion of the sling fabric is greatly simplified.

2. Related Art

Conventional outdoor furniture of the type intended for use on decks and patio are very popular. Manufacturers of outdoor patio furniture are constantly called upon to offer new innovative designs that provide practical, comfortable products to the consumer. Manufacturers on one hand are interested in offering the innovative designs, but are also interested in reducing manufacturing cost by simplifying and reducing the time to manufacture the outdoor patio furniture.

As the outdoor patio furniture industry has developed, a popular design for chairs, loungers, and the like is a supporting web that is suspended between a frame of a chair to support the user of the chair. These supporting web style chairs are commonly known as sling chairs. Although the sling chair construction arose since it is easier and less expensive to construct the sling and the chair frame separately, however, it has become apparent that there are short comings to the conventional construction and manufacture of sling-style chairs.

What is needed is a sling chair that simplifies conventional sling chair construction and reduces waste and effort associated with the manufacture and construction of sling chairs.

SUMMARY OF INVENTION

A method and apparatus for a novel single sling chair are disclosed which overcome disadvantages of previous sling chair construction. The novel sling chair construction reduces waste associated with ripping sling fabric panels and misfitting sling fabric panels. The manufacturing steps are simplified by reducing the incidence of having to thread the fabric panels along the length of the sling fabric groove. Instead of having to attach the sling fabric early in the construction, the sling fabric can be attached near the end of construction when the entire frame of the chair is completed which greatly reduces the incidence of the sling fabric being cut or marred. Accordingly, the sling chair comprises a chair frame, a seat panel coupled to the chair frame, a fabric back panel having length and first and second terminating loops at opposing ends with a first rod inserted through the first terminating loop and a second rod inserted through the second terminating loop for attaching the fabric back panel to the chair frame wherein the chair frame includes, an upper rail having an interior side configured to forceably receive the first rod and the first terminating loop, and a lower rail having an interior side configured to slidably receive the second rod and the second terminating loop wherein the lower rail is separate and configured to securely attach to the chair frame forming a back rest.

In accordance to another embodiment of the present invention, the lower rail is configured with screw threads and receives a screw that secures the lower rail to a lower cross member of the chair frame.

In accordance to another embodiment of the present invention, the fabric back panel is tensioned as the screw is tightened against the lower cross member. Tightening the screw can make adjustments to the fabric back panel if the fabric is too loose.

In accordance to another aspect of the present invention, a decorative cross member is configured above the upper rail to extend the back rest. Depending on the desired effect, the decorative cross member can be changed to produce a different effect.

In accordance to yet another aspect of the present invention, the decorative cross member includes an upper support cross member to provide additional support for the back rest. The upper support cross member also provides a hand hold for the user to easily grasp and move the chair.

DETAILED DESCRIPTION

Figure 1:
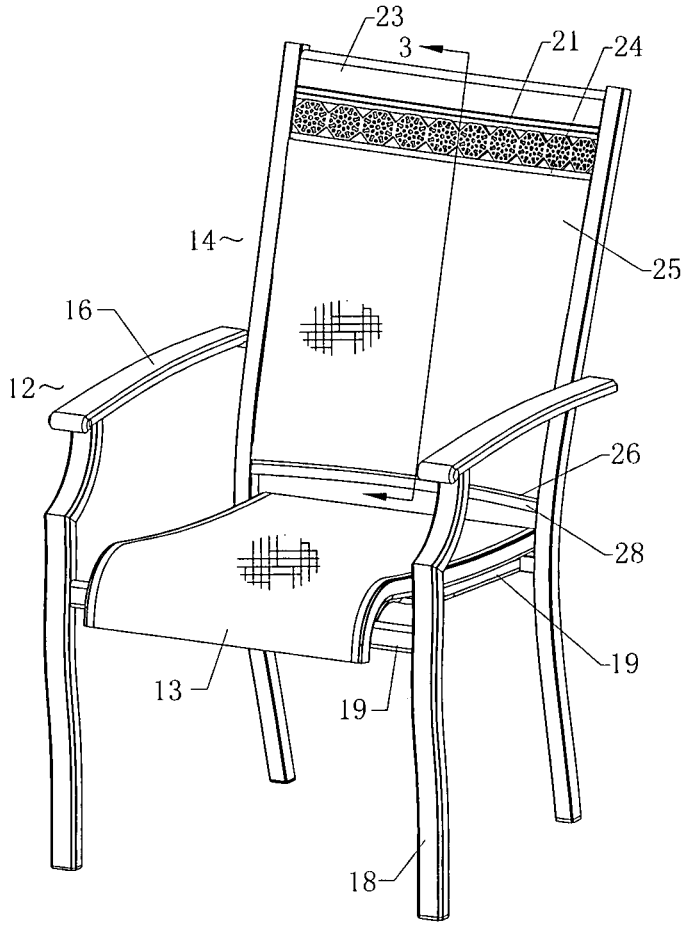
FIG. 1 illustrates a single sling chair in accordance with an embodiment of the present invention.

FIG. 1 illustrates a single sling chair 10 in accordance with an embodiment of the present invention. The single sling chair 10 includes a chair frame 12, a seat section 13, and a back section 14. The general construction of the single sling chair is conventional and well known to those skilled in the art of making patio chairs. A detailed discussion of how of the chair is constructed will detract from the spirit of the present invention. Therefore, a terse discussion of the general construction of the chair is given. Essentially, the chair frame is formed by attaching symmetrical halves of the chair frame that include an arm rest 16, legs 18 with cross supports 19. The seat section 13 is attached to the chair frame 12. The back support 14 includes a decorative cross member 21 and a cross support member 23 to not only give the back support decorative appeal but also added strength. In accordance to a present embodiment, the seat section 13 and the back section 14 are covered with fabric panels. The fabric panel of the seat section 13 is covered using conventional construction. However, the fabric panel of the back section is covered using a novel single sling construction. The back section 14 includes an upper rail 24, a sling fabric 25, a lower rail 26, and lower back cross member 28. The sling fabric 25 is of conventional construction consisting of a fabric back panel having a length and terminating loops at opposing ends and rods inserted into the loops for attaching the fabric back panel.

Figure 2:
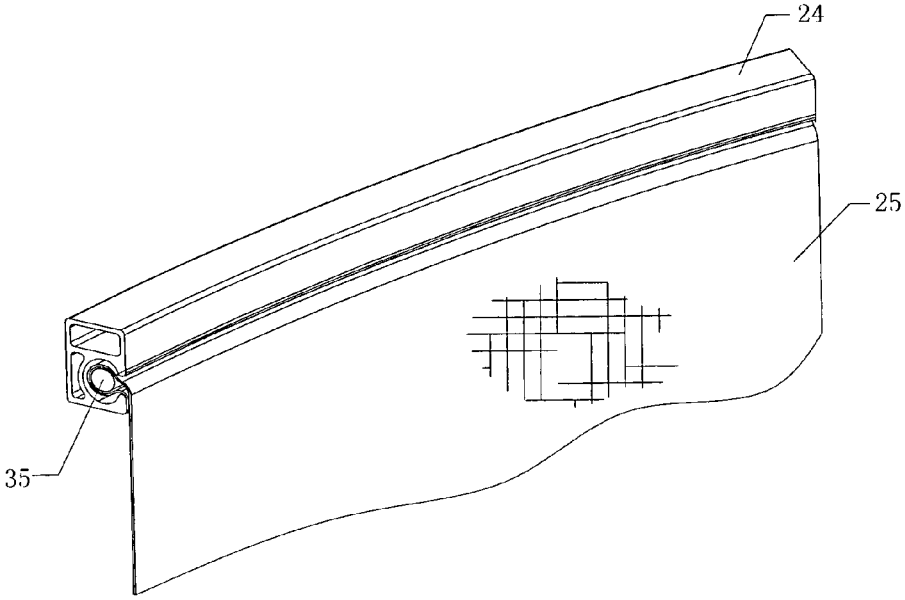
FIG. 2 illustrates an upper rail with an upper end of a sling assembly assembled into an interior side of the upper rail in accordance with an embodiment of the present invention.

FIG. 2 illustrates the upper rail 24, the sling fabric 25 with an upper rod 35 inserted into the sling fabric terminating loop and fitted into an interior side of the upper rail 24. The interior side of the upper rail 24 is constructed to receive and secure the upper rod 35 of the sling fabric 25. In accordance with an embodiment of the present invention, the interior side of the upper rail 24 is configured to flex in order to receive the upper rod 35. In other words, the upper rod 35 is pressed or forced into the interior side of the upper rail 24 with an aid of a small pry device such as a screw driver, pry bar, or the like. Essentially, no threading or sliding is used to insert the upper rod 35. The entire upper rod 35 is aligned with the length of the interior side of the upper rail 24 and is pressed or forced into the interior side of the upper rail 24 with an aid of a pry instrument, and there is no threading motion that is used to assemble the upper rod 35. Manufacture of the single sling chair 10 is greatly simplified by not having to thread or slide the upper rod 35 into the interior side of the upper rail 24 from one end of the upper rod 35. Sling fabric 25 can often rip during the threading or sliding process of the upper rod 35 into the interior side of the upper rail 24. Using the present embodiment of inserting the upper rod 35 directly into the interior side not only saves time but reduces the likelihood of ripping the fabric during installation. Instead of attaching the sling fabric early during construction, the entire frame of the chair can be constructed and attaching the sling fabric can be one of the last finishing step further reducing the likelihood of damage or soiling of the sling fabric.

Figure 3:
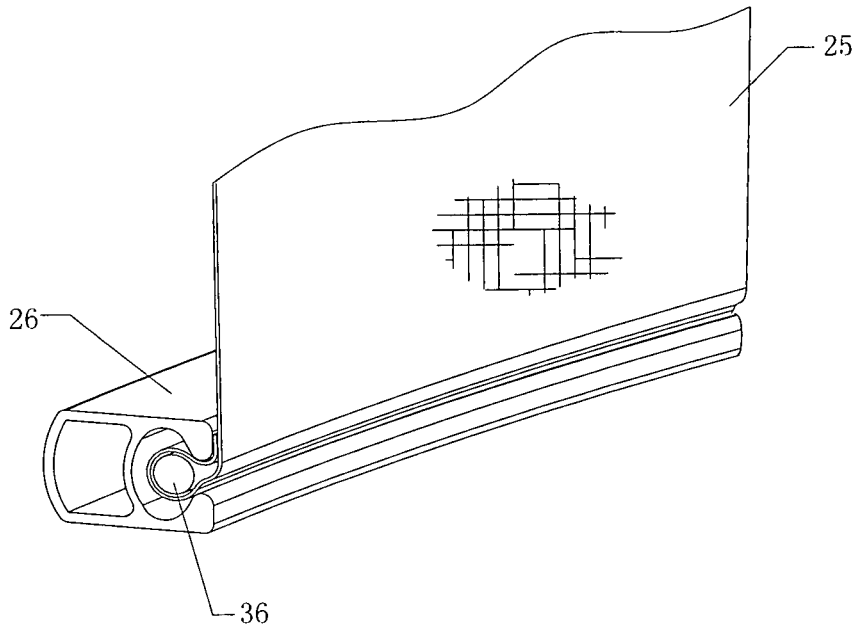
FIG. 3 illustrates a lower rail with a lower end of the sling assembly assembled into an interior side of the lower rail in accordance with an embodiment of the present invention.

FIG. 3 illustrates the lower rail 26, the sling fabric 25 with a lower rod 36 inserted into the sling fabric terminating loop and fitted into an interior side of the lower rail 26. Contrary to the interior side of the upper rail 24, the interior side of the lower rail 26 can not be flexed to insert the lower rod 36 into the interior side of the lower rail 26. Rather, the lower rod 36 is threaded into the interior side of the lower rail 26 using conventional sling construction technique. Since the lower rail 26 is separate and detached from the chair frame, threading or sliding the lower rod 36 into the interior side of the lower rail 26 from either end of the lower rail 26 is simplified and can be accomplished with rather ease.

Figure 4:
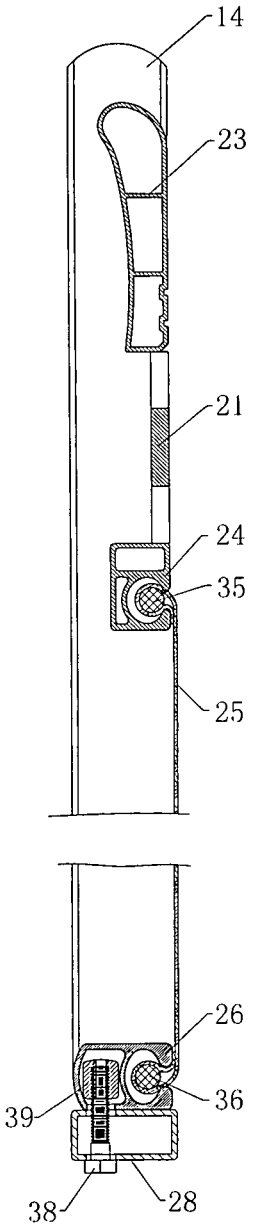
FIG. 4 illustrates an exemplary cut-out view of the chair back taken along line 3-3 of FIG. 1.

FIG. 4 illustrates a cutout taken along line 3-3 of FIG. 1. The upper back support 14 is shown with the cross support member 23, the decorative cross member 21, the upper rail 24 having the upper rod 35 assembled into the interior side of the upper rail 24, sling fabric 25, the lower rail 26 having the lower rod 36 assembled into the interior side of the lower rail 26, the lower back cross member 28, threaded screw/bolt 38, and threads 39. The lower rail 26 has a threaded hole 39 for receiving the threaded screw/bolt 38. The threaded screw 38 is screwed into the threaded hole 39 for attaching the lower rail 26 to the lower back cross member 28. As the threaded screw 38 is tightened, the sling fabric 25 tension can be adjusted. Accordingly, the present embodiment of the single sling chair simplifies the construction of the sling fabric back panel. For example, the entire chair frame can be assembled prior to assembly of the sling fabric back. The assembly of the sling fabric back is simplified by not having to thread the upper rod 35 including the sling fabric 25 into the interior side of the upper rail 24. According to an embodiment of the present embodiment, there is insufficient space to thread/slide the upper rod 35 into the interior side of the upper rail 24. By limiting the space and protrusions of the chair construction, more aesthetically appealing designs of sling style chair can be constructed. In addition, using the threaded screw 38 to attach the lower rail 26 with the lower rod 36 assembled to the interior side of the lower back cross member 28 enables tensioning and adjustment of the sling fabric which reduces waste during manufacturing when the sling fabric is not exactly the correct length. Conventional sling chair construction offers very little if any adjustment to the tension of the sling fabric.

The present novel single sling invention is susceptible to minor variations and modifications that may be introduced without departing from the inventive concept. For example, the fabric seat and seat back panel could be switched with the fabric seat incorporating the novel single sling construction.

It is further appreciated that designation of furniture as fitting into categories such as chairs, lounges, and other separate and distinct varieties may be inadequate. For example, patio furniture as opposed to furniture designs may show no clear delineation separating the two categories. Moreover, alternative configurations may be within the spirit of the invention if the frame were modified resulting in furniture that can be regarded as a cot, bed, as well as a chair, lounge, sofa, or similar furniture.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Moreover, the above disclosure is not intended to limit the present invention. The scope of the present invention is defined by the claims.

I claim:

1. A single sling chair comprising:

a chair frame;

a seat panel coupled to the chair frame;

a fabric back panel having length and first and second terminating loops at opposing ends with a first rod inserted through the first terminating loop and a second rod inserted through the second terminating loop for attaching the fabric back panel to a front side of the chair frame wherein the chair frame includes:

an upper rail having a forwardly facing "C" shaped interior side configured to flex and forceably receive the first rod and the first terminating loop from the front side of the forwardly facing "C" shaped interior side of the upper rail to secure the first rod and the first terminating loop to the forwardly facing "C" shaped interior side of the upper rail; and a lower rail having an interior side configured to slidably receive the second rod and the second terminating loop wherein the lower rail is separate and configured to securely attach to the chair frame forming a back rest.

2. The single sling chair of claim 1, wherein the lower rail is configured with screw threads and receives a screw that secures the lower rail to a lower cross member of the chair frame.

3. The single sling chair of claim 2, wherein the fabric back panel is tensioned as the screw is tightened against the lower cross member.

4. The single sting chair of claim 3 further comprising a decorative cross member configured above the upper rail to extend the back rest.

5. The single sling chair of claim 4, wherein the decorative cross member includes an upper support cross member to provide additional support for the back rest.

6. A sling chair comprising:

a chair frame having a back section with an upper rail and a lower cross member and a seat section wherein the chair frame includes a front side and a back side;

a seat panel coupled to the seat section of the chair frame;

a fabric back panel having length and first and second terminating loops at opposing ends with a first rod fitting inside the first terminating loop and a second rod fitting inside the second terminating loop;

an upper rail having a forwardly facing "C" shaped interior side configured to flex and forceably fit the first rod and the first terminating loop from the front side of the forwardly facing "C" shaped interior side of the upper rail to secure the first rod and the first terminating loop; and a lower rail having an interior side configured to fit the second rod and the second terminating loop into the interior side of the lower rail wherein the lower rail is attached to the lower cross member of the chair frame to form a back rest for the back section.

7. The single sling chair of claim 6, wherein the lower rail is configured with screw threads to receive a screw to secure the lower rail to the lower cross member of the chair frame.

8. The single sling chair of claim 7, wherein the fabric back panel is tensioned as the screw is tightened against the lower cross member.

9. The single sling chair of claim 6 further comprising a decorative cross member configured above the upper rail to extend the back rest.

* * * * *